United States Patent [19]

Witt

[11] Patent Number: 4,597,504

[45] Date of Patent: Jul. 1, 1986

[54] NON-METALLIC CONTAINER FOR FLAMMABLE FLUID AND METHOD

[75] Inventor: Edward H. Witt, Mattoon, Ill.

[73] Assignee: Justrite Manufacturing Company, Des Plaines, Ill.

[21] Appl. No.: 751,892

[22] Filed: Jul. 5, 1985

[51] Int. Cl.[4] ..... B65D 25/00

[52] U.S. Cl. ..... 220/88 R; 222/472; 222/505; 264/240

[58] Field of Search ..... 220/88 R; 222/472, 505, 222/474, 556, 469–471, 575; 264/239, 240

[56] References Cited

U.S. PATENT DOCUMENTS

| | | | |
|---|---|---|---|
| 2,685,386 | 8/1954 | Lisciani | 220/88 R |
| 2,792,159 | 5/1957 | Richmond | 222/472 |
| 3,811,605 | 5/1974 | Flider | 222/472 |
| 4,394,937 | 7/1983 | Flider | 222/505 |
| 4,489,860 | 12/1984 | Flider | 222/505 |
| 4,492,319 | 1/1985 | Cooper | 220/88 R |

*Primary Examiner*—George T. Hall
*Attorney, Agent, or Firm*—Irwin C. Alter

[57] ABSTRACT

A container for flammable fluid has an insulating plastic container body, metallic structural handle parts carried on the plastic container, a delivery port, and a metallic screen flame arrestor positioned across the delivery port.

In accordance with this invention, an insert is sealed within the plastic container body in contact with both the structural handle member parts and the screen flame arrestor. The insert comprises an electrically conductive mixture of a plastic which is sealingly compatible with the plastic of the container body, and a finely divided, electrically conductive material. Accordingly, differences in static electric potential between the screen flame barrier and the structural handle member parts may be minimized to eliminate static electric sparks.

12 Claims, 9 Drawing Figures

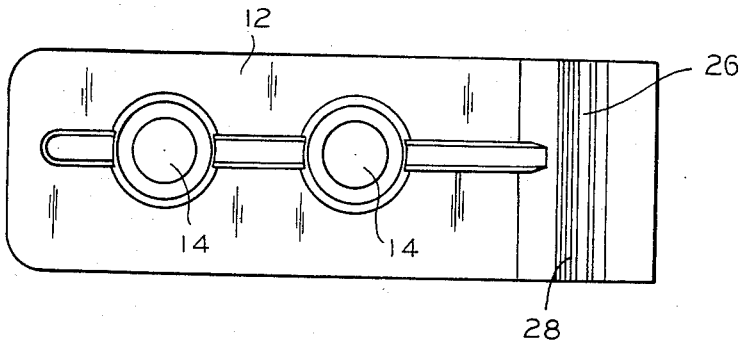
FIG. 5
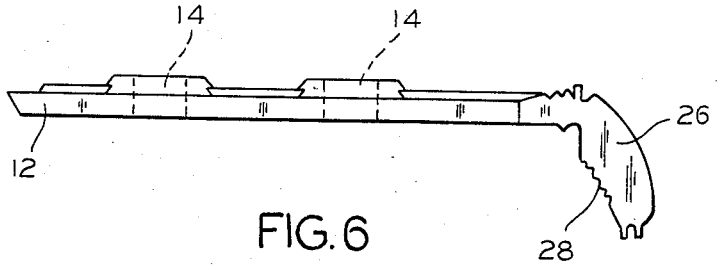
FIG. 6
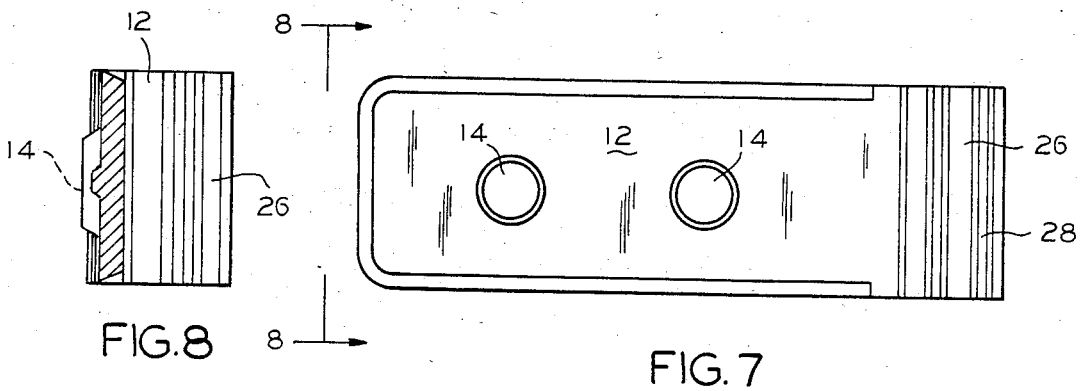
FIG. 8
FIG. 7
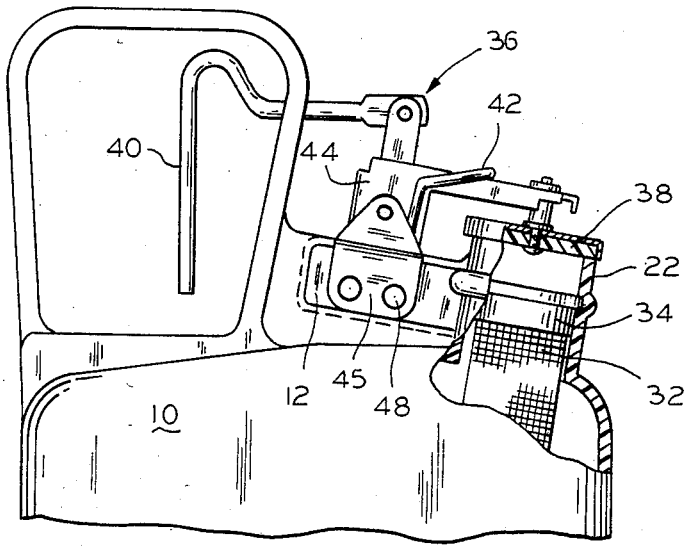
FIG. 9

NON-METALLIC CONTAINER FOR FLAMMABLE FLUID AND METHOD

BACKGROUND OF THE INVENTION

Flider U.S. Pat. No. 3,811,605 discloses a completely enclosed plastic container which is for the safe storage of flammable fluids. While the container body is plastic, it carries a handle and linkage control made out of metal for opening and closing the port of the container. Also, within the port of the plastic container, a metallic filter screen arrangement is provided to serve as a flame arrestor.

The invention of this application relates to an improved method and apparatus for grounding metallic parts which are within an insulating plastic container. By this invention, concentrations of static electric charge which collect in such an interior metal part may be equalized or grounded by means of an electrical connection with other metallic parts. There, static electric charge can be dissipated as the hand of the user touches the metal parts, or by simple dissipation into the ambient atmosphere. Thus, the build-up of static electric potential on the metal parts of an insulating plastic container can be minimized for the assured absence of static electric sparks.

DESCRIPTION OF THE INVENTION

This invention relates to a container, typically for flammable fluids, having an insulating plastic container body, metallic structural handle member means carried on the plastic container, a delivery port, and a metallic screen flame arrestor positioned across the delivery port, to prevent the migration of flame into the container. The term "insulating plastic" refers primarily to electrical insulation.

In accordance with this invention, an insert is sealed within the plastic container body in contact with both the structural handle member means and the screen flame arrestor. The insert comprises an electrically conductive mixture of a plastic which is sealingly compatible with the plastic of the container body, and a finely divided, electrically conductive material. As a result of this, differences in static electric potential between the screen flame barrier and the structural handle member means may be minimized by grounding, to eliminate static electric sparks.

Broadly, this invention makes use of such an insert, sealed within the wall of a plastic container body, and having portions which are respectively exposed to the interior and exterior of the container. Metallic parts carried by the container may then respectively be in contact with the interior and exterior facing surfaces of the insert, to provide an electrically conductive path through the wall of the container by way of the insert.

The insert is generally sealed within the plastic container body so as to prevent any leakage from the container interior through the wall around the insert. For this reason, a sealingly compatible plastic is chosen for the insert, typically the same plastic out of which the plastic container body is made. For example, high density polyethylene may be used to manufacture both the container body and the insert member, since the same polyethylene materials will be sealingly compatible with each other. However, other appropriate plastic materials may be used as is convenient or desirable.

The insert may be placed into an injection mold or blow mold, for example, to manufacture the container carrying said insert in accordance with typically known molding technology. In the case of blow molding, the insert is embedded on the outside of the container wall. Generally, one then must grind away a portion of the inside wall of the container over which the insert lies, to permit contact between the metallic part or parts in the container and the insert.

The insert typically contains a dispersed finely divided, electrically conductive material such as carbon black to improve the conductivity of the insert. Preferably, in the design for obtaining results the insert will create from about 70–200 ohms resistance. While carbon black is mentioned, it of course should be realized that other inserts that achieve the optimum resistance can be used. Thus, finely divided metal such as aluminum powder, iron filings, or the like, may be used if desired as an alternative or an additive to the carbon powder.

The plastic container of this invention may be made by embedding the insert in the wall of a container adjacent the delivery port, typically during molding, with the insert being of the electrically conductive material as described above. One then can mount the metallic screen flame arrestor into the delivery port of the container in electrically conductive contact with the insert, typically after a grinding step to expose the interior surface of the insert. One then may also mount other metallic members such as the handle member means on the exterior of the container in electrically conductive contact with the insert. The resulting device naturally equalizes static electric charge, which can otherwise accumulate on the flame arrestor through its contact with moving flammable liquids for example, for suppression of sparks.

DESCRIPTION OF THE DRAWINGS

In the drawings,

FIG. 5 is a top plan view of the insert used in this invention;

FIG. 6 is an elevational view of the insert of FIG. 5;

FIG. 7 is a bottom plan view of the insert of FIG. 5;

FIG. 8 is a view taken along line 8—8 of FIG. 7; and

FIG. 9 is a partial elevational view of the top of the container in its final, assembled form.

DESCRIPTION OF SPECIFIC EMBODIMENT

Figure 1:
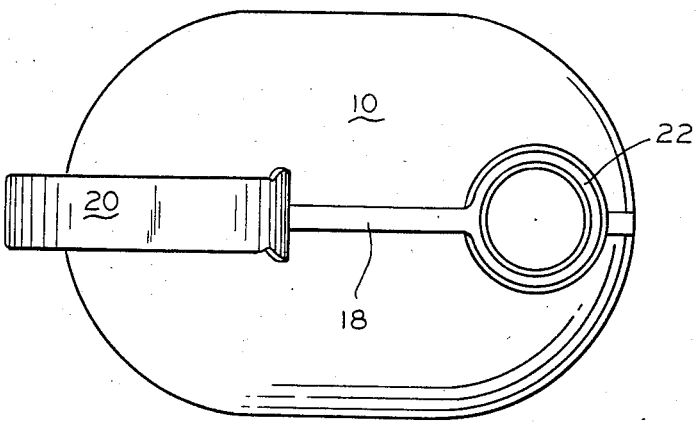
FIG. 1 is a plan view of a molded container to be used in accordance with this invention.
Figure 3:
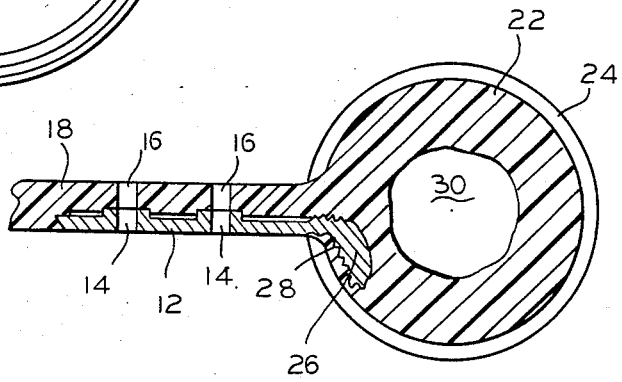
FIG. 3 is a sectional view taken along line 3—3 of FIG. 2, showing the container in as-molded condition.
Figure 2:
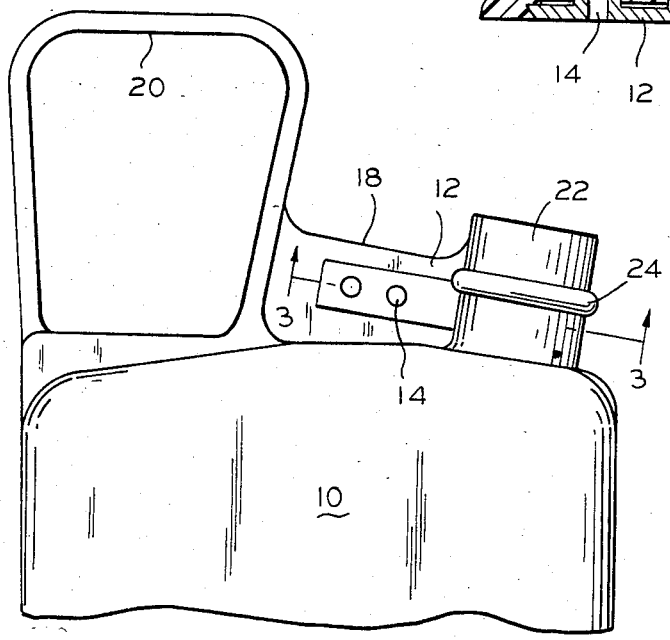
FIG. 2 is a fragmentary elevational view of the container of FIG. 1.

Referring to the drawings, FIGS. 1 through 3 show a container 10 which may be made of high density polyethylene, blow molded from a hot parison of molten plastic in conventional blow molding apparatus. Container 10 may carry, embedded in its wall, insert 12, which may be a separately molded piece of the shape shown in FIGS. 3, 5, 6, 7 and 8. Insert 12 may carry a pair of ports 14 which register with corresponding ports 16 in sealed portion 18 of container 10.

Container 10 carries plastic handle 20 as an integral, molded part thereof, as well as delivery port 22, including molded strengthening rib 24.

It can be seen that a portion 26 of insert 12 may be completely embedded in the plastic material of delivery port 22 (FIG. 3). The irregular edge portions 28 of insert 12 at portion 26 provide added gripping and bonding of insert 12 to the plastic of container 10 and particularly port 22.

Figure 4:
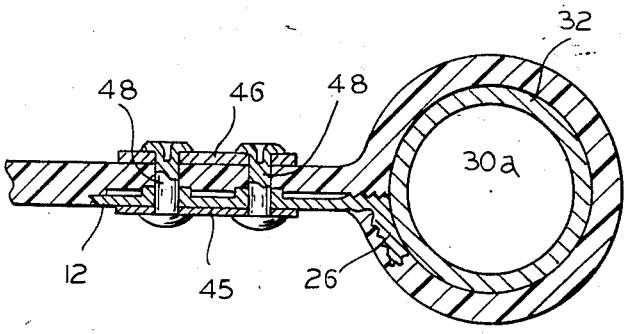
FIG. 4 is a sectional view similar to FIG. 3, showing the container after the grinding step has taken place.

Following the manufacture of container 10 as shown in FIGS. 1–3, delivery port 22 may be internally ground to enlarge its bore 30, also making it more uniform, and to expose embedded portion 26 of insert 12 to the interior of ground bore 30*a*, as shown in FIG. 4.

Following this grinding step, which exposes portion 26 of insert 12 by producing large bore 30*a*, metallic screen flame arrestor 32, of conventional design, may be placed into delivery port 22 and sealed to its inner bore (FIG. 9), with retaining ring portion 34 of flame arrestor 32 being in contact with the exposed inner surface of portion 26 of insert 12, so that metallic flame arrestor 32 is in electrically conductive contact with insert 12.

Metallic structural handle member 36 is present to permit manual opening and closing of spring-biased closure 38, for opening and closing of delivery port 22 by manipulation of handle 40. Spring member 42 is present to bias closure member 38 into the closed position by its action on lever arm 44, which is pivotally attached to brackets 45,46. Brackets 45,46, in turn, are retained on container 10 by rivets 48 (FIG. 4), each of which passes through a pair of registering apertures 14,16.

Most of the individual members of handle member 36 are metallic, with the exception of the internal liner of closure 38. Such metallic parts are in electrical contact with insert 12 by means of the physical contact of bracket 45 with insert 12.

Insert 12 may also be made of high density polyethylene, but also containing, in intimate admixture, enough weight to create an electrical resistance of from 70–200 ohms of carbon black. Thus insert 12 is a substantially conductive material, with the result that an electrical connection exists between screen flame arrestor 32 and the metallic parts of member 36, namely 15 bracket 45, lever arm 44, handle 40, spring 42, and the like. Further details of the structure of member 36 may be found in Flider U.S. Pat. No. 3,811,605. Except as otherwise described herein, the container of this invention may resemble products currently sold by the Justrite Manufacturing Company of Chicago, Ill.

Accordingly, the electrical connection provided between the internal and external metal parts of the plastic container of this invention provides the result that static electrical charge build-up on the flame arrestor can be minimized, to eliminate any risk of static electric sparks.

The above has been offered for illustrative purposes only, and is not intended to limit the scope of the invention of this application, which is as defined in the claims below.

I claim:

1. In a container for flammable fluids having an insulating plastic container body, metallic structural handle member means carried on said plastic container, a delivery port, and a metallic screen flame arrestor positioned across said delivery port, the improvement comprising, in combination:

an insert sealed within said plastic container body in contact with both said structural handle member means and said screen flame arrestor, said insert comprising an electrically conductive mixture of a plastic which is sealingly compatible with the plastic of said container body and a finely divided, electrically conductive material, whereby differences in static electric potential between said screen flame barrier and the structural handle member means are minimized, to eliminate static electric sparks.

2. The container of claim 1 in which said insert contains a certain weight percent of carbon powder or other filler that forms a resistance in the range of from 70 to 200 ohms.

3. The container of claim 2 in which said sealingly compatible plastic is polyethylene.

4. The container of claim 3 in which said container body is made of polyethylene.

5. In an insulating plastic container, the improvement comprising an insert sealed within said plastic container body in contact with both the interior and exterior of said container, said insert comprising an electrically conductive mixture of a plastic which is sealingly compatible with the plastic of said container body and a finely divided, electrically conductive material, whereby members inside and outside of said container may be positioned in an electrically conductive relation through said insert.

6. The method of molding an insulating plastic container defining a delivery port, the improvement comprising, in combination:

embedding an insert in the wall of said container adjacent said delivery port during said molding, said insert comprising an electrically conductive mixture of a plastic which is sealingly compatible with the plastic of said container body and a finely divided, electrically conductive material;

mounting a metallic screen flame arrestor into said delivery port in electrically conductive contact with said insert; and mounting other metallic members on the exerior of said container in electrically conductive contact with said insert.

7. The method of claim 6 in which said plastic container is blow molded, and thereafter an interior portion of said container wall is ground away to expose said insert to the container interior, for contact with said flame arrestor.

8. The method of claim 6 in which at least a portion of said insert is exposed to the exterior after molding, for contact with said other metallic members.

9. The method of claim 6 in which said insert contains a percentage weight of conductive powder so as to create a resistance of between 70 and 200 ohms.

10. The method of claim 9 in which said sealingly compatible plastic and container body are both made of polyethylene.

11. The method of blow molding an insulating plastic container defining a delivery port, the improvement comprising:

embedding an insert in the wall of said container adjacent said delivery port during said blow molding, said insert comprising an electrically conductive mixture of a plastic which is sealingly compatible with the plastic of said container body and wherein the percent by weight of the electrically conductive mixture creates from 70–200 ohms resistance;

grinding an inner portion of said container wall away to expose said insert to the container interior;

mounting a metallic screen flame arrestor into said delivery port in electrically conductive contact with said insert; and mounting other metallic members on the exterior of said container in electrically conductive contact with a portion of said insert which is exposed to the exterior after molding.

12. The method of claim 11 in which said sealingly compatible plastic and container body are both made of high density polyethylene.

* * * * *